US007458681B1

(12) United States Patent
Redding

(10) Patent No.: US 7,458,681 B1
(45) Date of Patent: Dec. 2, 2008

(54) HANGING EYEWEAR HOLDER

(76) Inventor: Terry Martin Redding, 1403 Oak St., NW., Washington, DC (US) 20010

( * ) Notice: Subject to any disclaimer, the term of this patent is extended or adjusted under 35 U.S.C. 154(b) by 217 days.

(21) Appl. No.: 11/472,887

(22) Filed: Jun. 23, 2006

(51) Int. Cl.
*A45C 11/04* (2006.01)

(52) U.S. Cl. ..... 351/155; 206/5

(58) Field of Classification Search ..... 359/811; 351/155; 24/3.8; 206/5; 383/22, 23
See application file for complete search history.

(56) References Cited

U.S. PATENT DOCUMENTS 3,799,416 A * 3/1974 Schmaltz ..... 294/142
6,328,469 B1 * 12/2001 Banco ..... 383/23

* cited by examiner

*Primary Examiner*—Joseph Martinez
(74) *Attorney, Agent, or Firm*—Dodds and Associates; John Dodds; Susanne Somersalo

(57) ABSTRACT

A floating, waterproof, hanging eyewear holder designed as a convenient receptacle for showering, exercising, swimming, and other situations where eyewear can be easily stored and retrieved. A pocket is made of two thin layers of plastic, molded together to create an air space in the rear of the pocket. The third, front layer of the pocket is webbed to allow easy evaporation of any liquid. A snap secures eyewear in the pocket. A molded, offset top hanger allows convenient suspension from such surfaces as a shower curtain rod, tree branch, or exercise bar. The end of the hanger is bent inward to form a toe, allowing the hanger to be hung on any flat surface, such as a chair arm, table, or window sill. A hole in the top of the hook accommodates a lanyard or a suction cup, allowing the hanger to be attached to glass or ceramic enclosures.

5 Claims, 6 Drawing Sheets

HANGING EYEWEAR HOLDER

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

This invention is related to existing eyewear holders and cases, and is designed for the purpose of easy storage of and access to eyewear such as eyeglasses and sunglasses, particularly in bathing, recreational, and exercise situations. Its flexible method of hanging is an improvement over permanently mounted eyewear holders. The holder also floats, is made of waterproof materials, and is designed particularly to be of recreational use in situations in which water is present, such as showers, baths, gyms, pools, open and salt water environments, boats, ships, and water parks, but is also not restricted to these situations.

The combination of a hook and pocket made of waterproof materials overcomes many limitations of current eyewear holder designs, the most similar of which are designed to keep eyewear completely dry, but which do not offer a range of hanging or placement options and which are somewhat bulky. Users will be able to use the holder in many home and recreational situations wherein the holder can be hung from within a variety of scenarios, such as from a shower curtain rod, a shower head, the top of a doorframe, a cabinet, the side of a sink, a beach chair arm, bicycle handlebars, exercise equipment, or around the neck with the use of a lanyard.

The invention provides an appropriate, temporary storage receptacle in many situations where eyewear would otherwise have to placed, for example, on a soap dish, beach chair, or other inconvenient, unsafe, or unstable location, and allows for the evaporation or draining away of any water in inadvertent contact with the eyewear.

Prior art in this application relates to numerous styles of eyeglass holders and styles of equipment hooks, none of which have ever been found to be used in combination. Such devices are as follows:

U.S. Pat. No. 1,088,406 to Davis
U.S. Pat. No. 1,580,643 to Binder
U.S. Pat. No. 1,995,664 to Boyes
U.S. Pat. No. 3,517,823 to Papineau
U.S. Pat. No. 3,647,056 to Jacobson et al.
U.S. Pat. No. 3,651,928 to Weisman
U.S. Pat. No. D328,085 to Rickabus
U.S. Pat. No. 5,052,550 to Pfenning
U.S. Pat. No. 5,551,126 to Wallo
U.S. Pat. No. 6,134,753 to O'Mahony

BRIEF SUMMARY OF THE INVENTION

This eyewear hanger has a pocket into which eyeglasses or sunglasses of various sizes can be stored, and an offset hook at the top that allows the user to hang the holder on any nearby horizontal surface or projection, such as a shower curtain rod or door frame.

The hanger is made of a waterproof material, with the lower half being a pocket area, the front of which is webbed, to allow any water contacting the hanger to drain away. The top of the webbing is reinforced by a band of waterproof material, with a snap in the middle to prevent eyewear from sliding out. The back side of the pocket is made of two plies of plastic material sealed to form an air space sufficient to allow the hanger to float when eyewear is inside. The pocket is slightly wider at the bottom to allow eyewear to rest inside at a slight angle, to make it less easy for eyewear to slide out of the pocket in case it is inverted without the snap being closed.

The top half of the holder consists of a rear offset hanger. At the end of the offset hanger is a small bend, creating a blunted end or toe, with a finely striated or ribbed underside, which allows the hanger to be hung securely enough on flat surfaces such as the arm of a chair, a table, a window frame or other trim, to present minimal risk of it sliding off. The apex of the hanger has a hole for the insertion of, for example, a suction cup, which would allow the hanger to be attached to nonporous vertical surfaces such as glass or ceramic tile. The hole may also be used with a lanyard, to hang the device from the neck or other convenient source.

One of the strong advantages of the holder is it allows use in situations such as a shower or while using exercise equipment, keeping eyewear in very close and easy proximity should eyewear be needed suddenly.

DETAILED DESCRIPTION OF THE INVENTION

Reference will now be made in detail to the preferred embodiments of the invention, examples of which are illustrated in the accompanying drawings.

Figure 1:
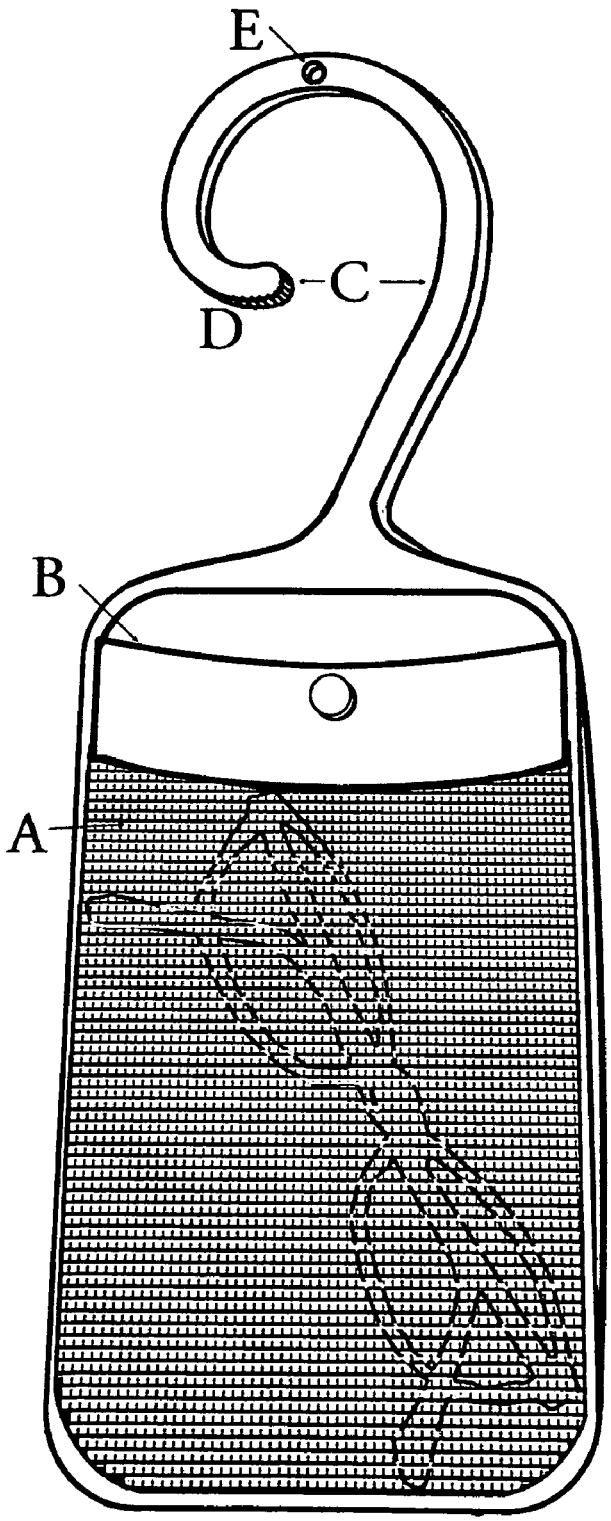
FIG. 1 is a perspective from the front of the holder demonstrating how a pair of closed eyeglasses would be held in typical use of the holder.

FIG. 1, a frontal view, shows many features of the invention. The webbed area which retains the eyewear is in the lower portion of the invention shown by letter A. The opening noted by letter B is large enough to accommodate a variety of eyewear styles and is reinforced by a band of the same waterproof material as the rear plies. The bottom is slightly wider than the top opening, with the intent of allowing the eyewear to sit at an angle once inside, and be less likely to slide out if the invention is dropped. A small snap at the center of the band above the webbing (letters F and G) can also be fastened to prevent eyewear from sliding out. All the materials are flexible to allow for easy storage and for general comfort and ease of use.

The lower portion of the invention consists of a pocket of sufficient size for most typical eyeglasses or sunglasses to fit comfortably and securely. The rear wall of the pocket consists of two layers of thin but durable plastic, which are heat sealed along all edges with sufficient air between the layers (letter H) to allow the invention to float with eyewear inserted. Towards the center top of the wall is the rear portion of a plastic snap (G), which is aligned with the front portion of a snap described herebelow. The front portion of the pocket consists of durable plastic webbing large enough to allow for easy evaporation of any liquids coming into contact with the invention and eyewear, while still securely holding the eyewear within and allowing the eyewear to be easily seen by the user.

The top edge of the pocket webbing is heat sealed to a horizontal band of the same plastic used for the rear wall, the top center of which holds the front portion of a plastic snap (F), aligned with the rear portion of the snap mounted on the back wall of the pocket (noted above). The left and right sides and the bottom of the front webbed portion of the pocket are heat sealed to the rear wall, with a narrow opening remaining at the top of the front wall (B), thus creating said pocket in which to place eyewear. The pocket is of sufficient depth to accommodate most typical eyewear and in order to allow closure of said plastic snap.

Figure 3:
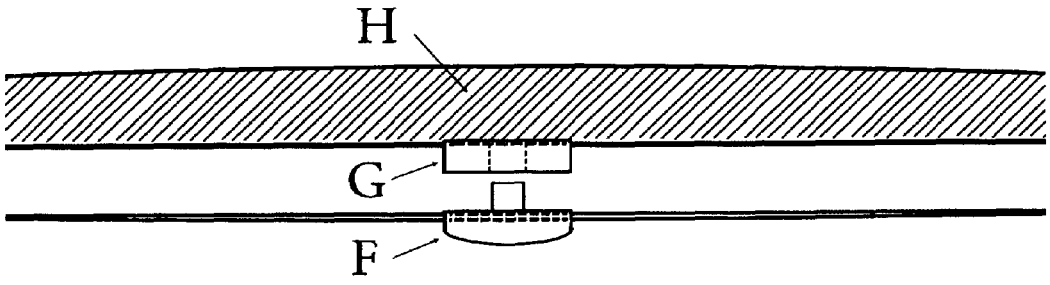
FIG. 3 is a cross-sectional view from above of the holder, showing the air space created that allows the holder to float.

The air space (H) and snap are best seen in FIG. 3, a cross-sectional view of the area of the invention in which the eyewear is placed, viewed from the top, at the midsection point where the reinforcing band at the top of the webbing holds the snap (F and G). The snap also allows eyewear to be securely inserted and carried, for example, in a bag or purse, or around the neck from a lanyard.

Figure 2:
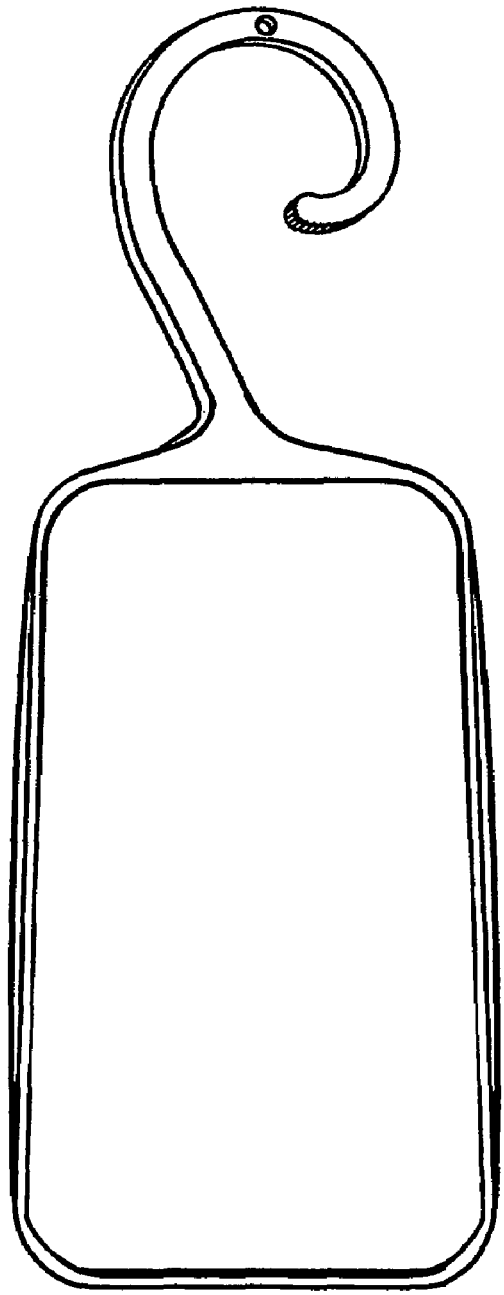
FIG. 2 is a rear view of the holder.
Figure 6:
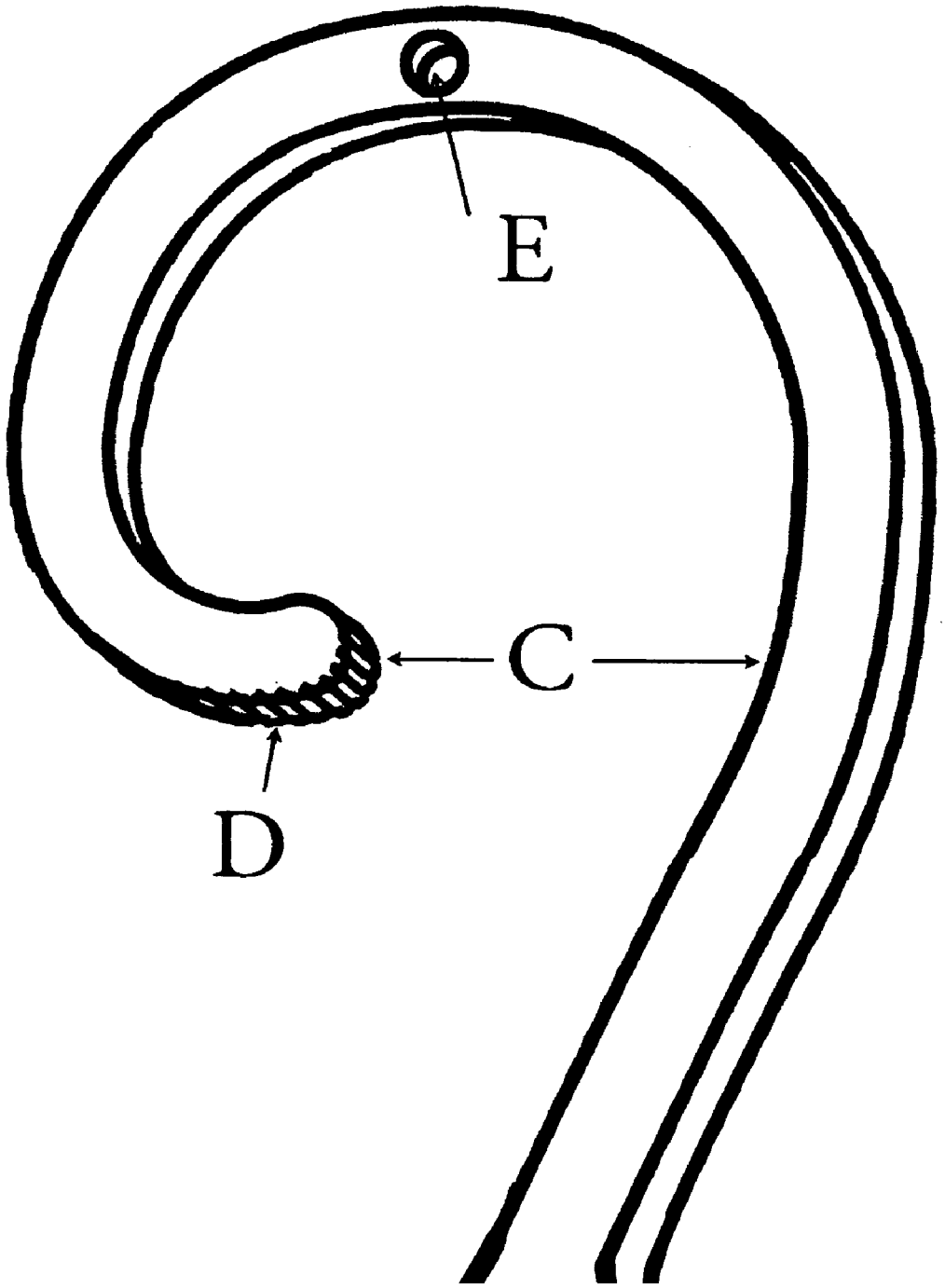
FIG. 6 is a close up of the neck of the hanger, to allow a better view of the toe at the end of the hanger.

The upper hook portion of the invention is seen in FIGS. 1 and 2, with FIG. 6 being a close up view. The top portion of the invention consists of a hook-shaped hanger made of rigid plastic, of a stiffer grade than used for the pocket, which is flared flat and horizontally across the bottom of a sufficient width on the left and right sides to align evenly with the top rear wall of the lower pocket portion of the invention. The top of the rear wall of the pocket and the bottom edge of the hook are heat bonded.

The opening of the hanger is wide enough (C) to accommodate standard pole sizes of typical closet and shower curtain rods. The toe at the end of the hanger (D) is essentially a 90 degree inward bending of the end of the hanger, and is described in more detail below. An eyelet at the apex of the hanger (E) allows the insertion of an optional suction cup to attach the invention to vertical, nonporous surfaces such as glass and ceramic tile, or the insertion of a lanyard to hang the invention from the neck or other irregularly shaped surface.

Figure 4:
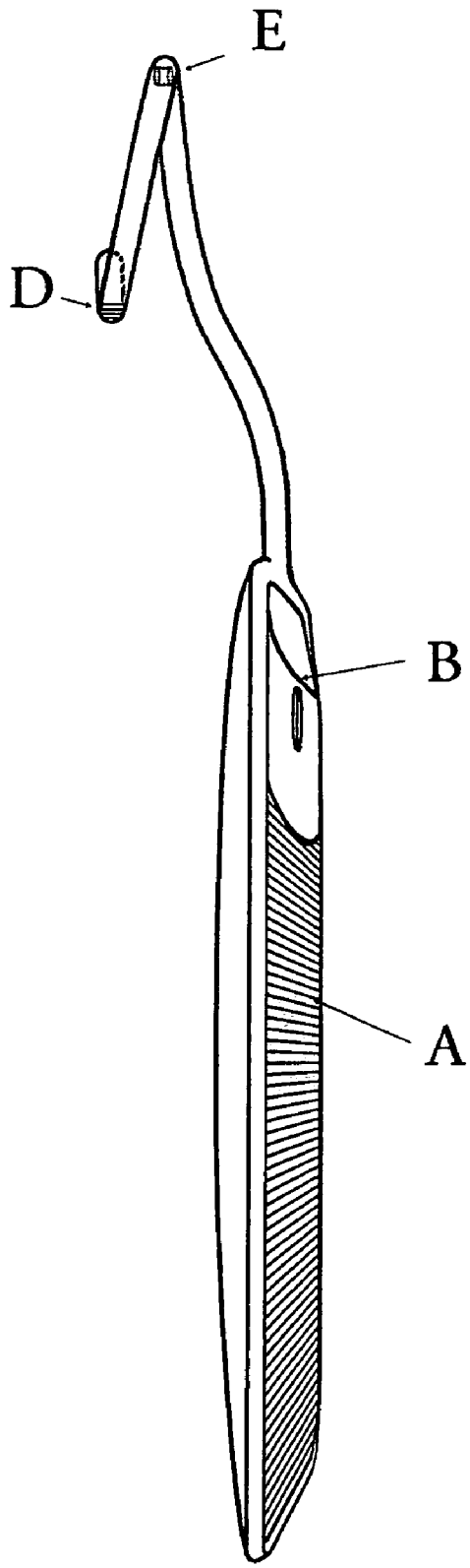
FIG. 4 is a side view of the holder, which shows the offset nature of the hanger.
Figure 5:
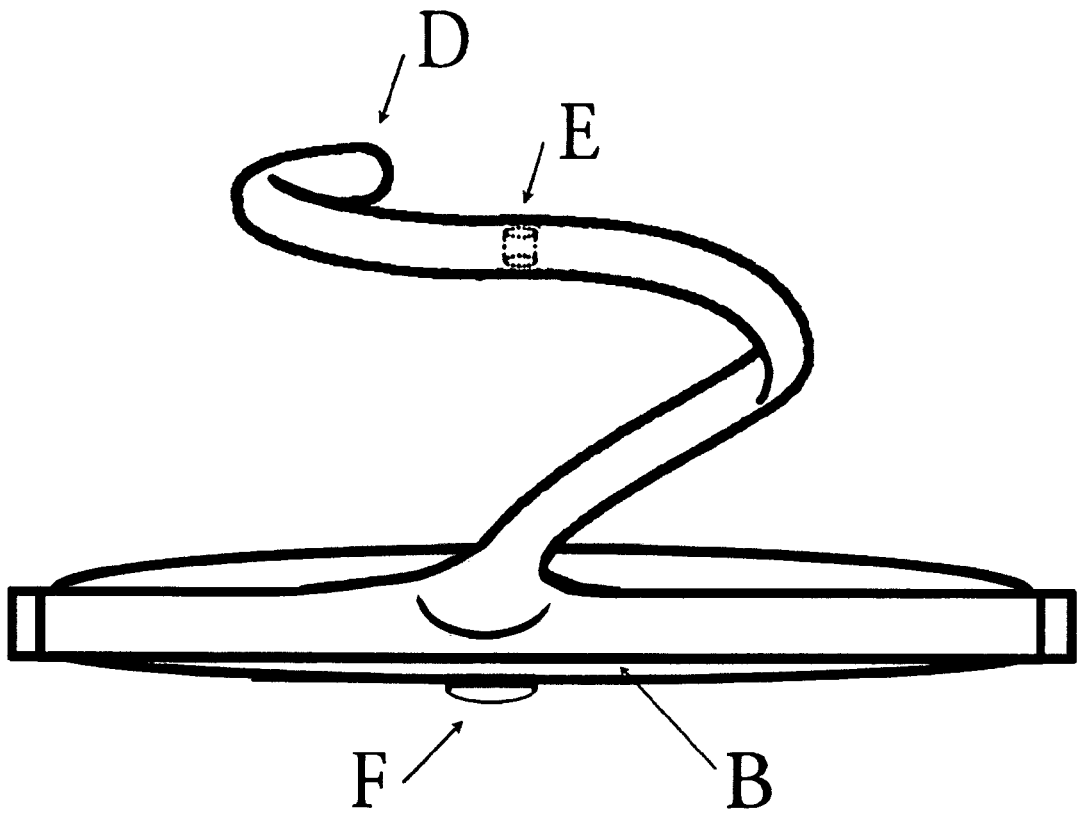
FIG. 5 is a top view of the holder.

FIG. 4 is a view from the left side of the invention that demonstrates the offset nature of the neck of the hanger, allowing the invention to be hung from a vertical surface, such as the top of a door, and to remain in place without being forced askew from the door itself. The offset allows for the invention to attain a better grip by the ability to be recessed more deeply on any given horizontal surface. FIG. 5 is a top view looking down on the invention, also showing the offset neck of the hanger as well as the narrow opening to the webbed pocket (B). This view further displays how the offset nature of the hanger allows the invention to be hung more securely and flat from door or window framing trim, allowing the hook to better grip more deeply into the horizontal surface, without causing the invention to cantilever out away from the given flat, vertical surface.

As noted previously, the end tip of the hanger is bent back towards the neck to create a toe roughly parallel with the bottom edge of the pocket. FIG. 6 is a close up of the hooked area of the invention, showing the toe at the end of the hanger (D). The bottom of the toe is finely ribbed to allow for better gripping of any horizontal surface, such as the arm of a wooden chair. The toe is also slightly curved, allowing the invention to pivot, once hung, to its optimal position of balance.

While the invention has been shown and described herein in what are conceived to be the most practical and preferred embodiments, it is recognized that departures may be made therefrom within the scope of the invention, which is therefore not limited to the details disclosed herein, but is to be afforded the full scope of the claims to as to embrace any and all equivalent apparatus and articles.

What is claimed is:

1. A hanging eyewear holder consisting of:

a pocket having a top, and a bottom, bounded by a back wall and a front wall defining a cavity, said top having an opening into the cavity;

said back wall having a top, a bottom and two sides and further consisting of a first, and a second layer, said first and said second layer being made of waterproof material, and each layer having a top, a bottom and two sides;

said tops, bottoms and sides of the first and second layers being molded together leaving an air space in between the first and the second layer;

said front wall being made of webbed material and having a top, a bottom and two sides, and said bottom being sealed to the bottom of the back wall, said sides being sealed to the sides of the back wall, and said top forming the opening into the cavity; and a semi-rigid plastic hanger molded to the top of the back wall of the pocket.

2. The hanging eyewear holder of claim 1, wherein said hanger has a tip and a neck, said tip being horizontally bent at its end, back towards the neck, thereby forming a toe slightly curved, and roughly parallel with the bottom of said pocket, allowing the holder to be hung on flat, horizontal surfaces; and further having a lower surface and an upper surface and being narrowly ribbed on the lower surface, allowing a better gripping surface, and allowing said holder to pivot to its optimal position of balance while resting on a horizontal surface.

3. The holder of claim 2, wherein the hanger has a hole or an eyelet between the tip and the neck.

4. The hanging eyewear holder of claim 1, wherein:

the front wall has a horizontal band of waterproof material at its top; and said waterproof band further having a mechanism to fasten the front wall to the back wall of the holder.

5. The holder of claim 1, wherein the pocket is slightly flared at its bottom.

* * * * *